US009842575B1

(12) United States Patent
Feng

(10) Patent No.: US 9,842,575 B1
(45) Date of Patent: Dec. 12, 2017

(54) MUSIC BOX

(71) Applicant: Chen-Hsiang Feng, Taipei (TW)

(72) Inventor: Chen-Hsiang Feng, Taipei (TW)

( * ) Notice: Subject to any disclaimer, the term of this patent is extended or adjusted under 35 U.S.C. 154(b) by 0 days.

(21) Appl. No.: 15/618,128

(22) Filed: Jun. 9, 2017

(51) Int. Cl.
*G10F 1/06* (2006.01)
*G10F 5/04* (2006.01)

(52) U.S. Cl.
CPC . *G10F 5/04* (2013.01); *G10F 1/06* (2013.01)

(58) Field of Classification Search
CPC ..... G10F 1/06; G10F 1/00; G10F 5/00
See application file for complete search history.

(56) References Cited

U.S. PATENT DOCUMENTS 5,331,110 A * 7/1994 Chen ..... G10F 1/06 446/298
5,498,833 A * 3/1996 Huang ..... G10F 1/06 446/303

* cited by examiner

*Primary Examiner* — Kimberly Lockett

(57) ABSTRACT

A music box includes a box, an operation unit, multiple activation units and a comb member. A circuit board controls a coil in a desired one of the activation units to create a magnetic field with the magnetic plate so as to attract the activation plate to be matched with the match plate. The attached activation plate and the match plate are rotated by a shaft extending through the activation units. The shaft is driven by a driving member. Each activation plate includes fingers which push the keys of the comb member to generate sound.

9 Claims, 11 Drawing Sheets

MUSIC BOX

BACKGROUND OF THE INVENTION

1. Fields of the Invention

The present invention relates to a music box, and more particularly, to a music box with small size and the music can be changed.

2. Descriptions of Related Art

The conventional music boxes comprise two types, one of which is called cylinder music boxes, and the other one is called disc music boxes. Generally, the music boxes include a coil, a comb member and a cylinder. The comb member includes multiple keys, and the cylinder includes multiple protrusions which move and lift the free ends of the keys, so that when the protrusions pass over the keys, the keys vibrate to generate a specific sound depending on the length of the keys.

Nevertheless, the music boxes can only play a single piece of song. In order to play different ranges, scales and tones, the size of the music boxes and the electro-magnetic device in the music boxes have to be big enough. The big music boxes are not convenient for carry. If the users want to change the music that the music box plays, both of the comb member and the cylinder have to be replaced. This is difficult for general users to replace new comb member and cylinder.

The present invention intends to provide a music box that is compact in size and the music that the music box plays can he easily changed.

SUMMARY OF THE INVENTION

The present invention relates to a music box and comprises a box having an electric power unit and a circuit board received therein. A driving member is located on the top surface of the box. An operation unit is located on the top surface of the box and connected to the driving member. A first support and a second support are respectively located on the top surface of the box. The operation unit is connected to the first support that is located adjacent to the driving member.

Multiple activation units are located between the first and second supports, and are connected to the operation unit. Each activation unit has a magnetic plate, a match plate, an activation plate and a spring. A shaft extends through the multiple activation units, and the two ends of the shaft are connected to the first and second supports. The spring is located between the between the match plate and the activation plate of each activation unit. The sequence of the magnetic plate, the match plate, the activation plate and the spring on the shaft of each activation unit is that the magnetic plate is located close to the driving member and the activation plate is located remote from the driving member. A coil is electrically connected with the circuit board and located between the magnetic plate and the match plate of each activation unit. The match plate of each activation unit has multiple protrusions extending from one side thereof that faces the activation plate which has multiple holes which are located corresponding to the protrusions. The circuit board controls the coil to generate electric power to magnetically attract the activation plate to match the match plate so as to engage the protrusions with the holes. The driving member drives the operation unit to spin the shaft which rotates the match plate and the activation plate that is matched with the match plate.

A comb member is located on the top surface of the box and has multiple keys extending therefrom. The keys are located corresponding to the activation plates of the activation units. Each activation plate has multiple lingers extending from the outer periphery thereof. The fingers push the keys to generate sound.

Preferably, the box includes a bottom part and a top part, and the bottom part includes a am defined therein. The electric power unit and the circuit board are received in the room. The top part is mounted to the bottom part to seal the room. The top part includes multiple slots. Each magnetic plate includes a connection portion which is positioned in the slot corresponding thereto.

Preferably, the first support that is located adjacent to the driving member includes two first side plates and a first bottom plate which is connected between the two first side plates. The first bottom plate is fixed to the top part by screws. A space is formed between the two first side plates of the first support. The second support includes a second bottom plate fixed to the top part by screws, and a second side plate which is connected the first bottom plate to form an L-shaped arrangement.

Preferably, the operation unit includes a first threaded rod, a second threaded rod and a wheel gear. The first threaded rod is connected to an output axle of the driving member and located in the space. The second threaded rod is connected between the one of the two first side plates and the second side plate. The second threaded rod includes a disk gear formed thereto which is engaged with the first threaded rod. The second threaded rod includes an operation gear on one end thereof which protrudes beyond one of the two first side plates. The operation gear is located corresponding to the activation units. The wheel gear is mounted to the shaft and engaged with the operation gear.

Preferably, the shaft includes a polygonal section and two pivotal sections between which the polygonal section is located. Each match plate has an aperture which is shaped to be matched with the polygonal section.

Preferably, the comb member includes 18, 20, 30, 40 or 70 keys.

Preferably, the magnetic plate of each activation unit includes a groove defined in one side thereof which faces the match plate corresponding thereto. The coil is located in the groove.

Preferably, the circuit board includes a control unit, a receiving unit and a record access unit. The control unit controls at least one coil to generate electric power so as to form magnetic field with the magnetic plates. The receiving unit receives music from a mobile device by wireless way. The record access unit stores and transfer the music into multiple music codes.

Preferably, the circuit board and the mobile device are connected to each other by way of Bluetooth, cloud or infer-red.

The music box of the present invention is a compact music box wherein the magnetic plates, the match plates and the activation plates occupy less space.

The shaft is accurately rotated by the engagement between gears so as to precisely activate the keys of the comb member.

The music that played by the music box can be changed by changing the comb member.

The present invention will become more apparent ftom the following description when taken in connection with the accompanying drawings which show, for purposes of illustration only, a preferred embodiment in accordance with the present invention.

DETAILED DESCRIPTION OF THE PREFERRED EMBODIMENT

Figure 1:
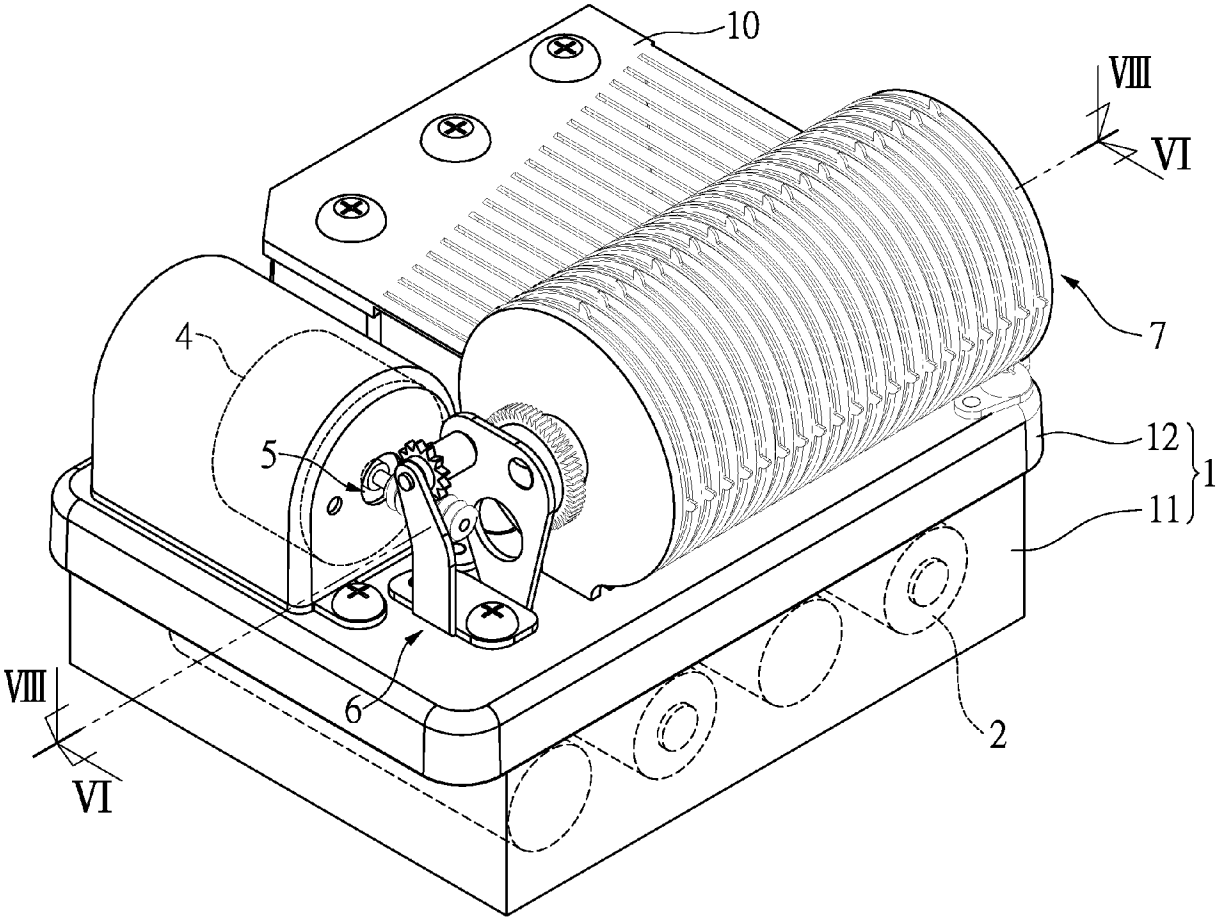
FIG. 1 is a perspective view to show the music box of the present invention.
Figure 2:
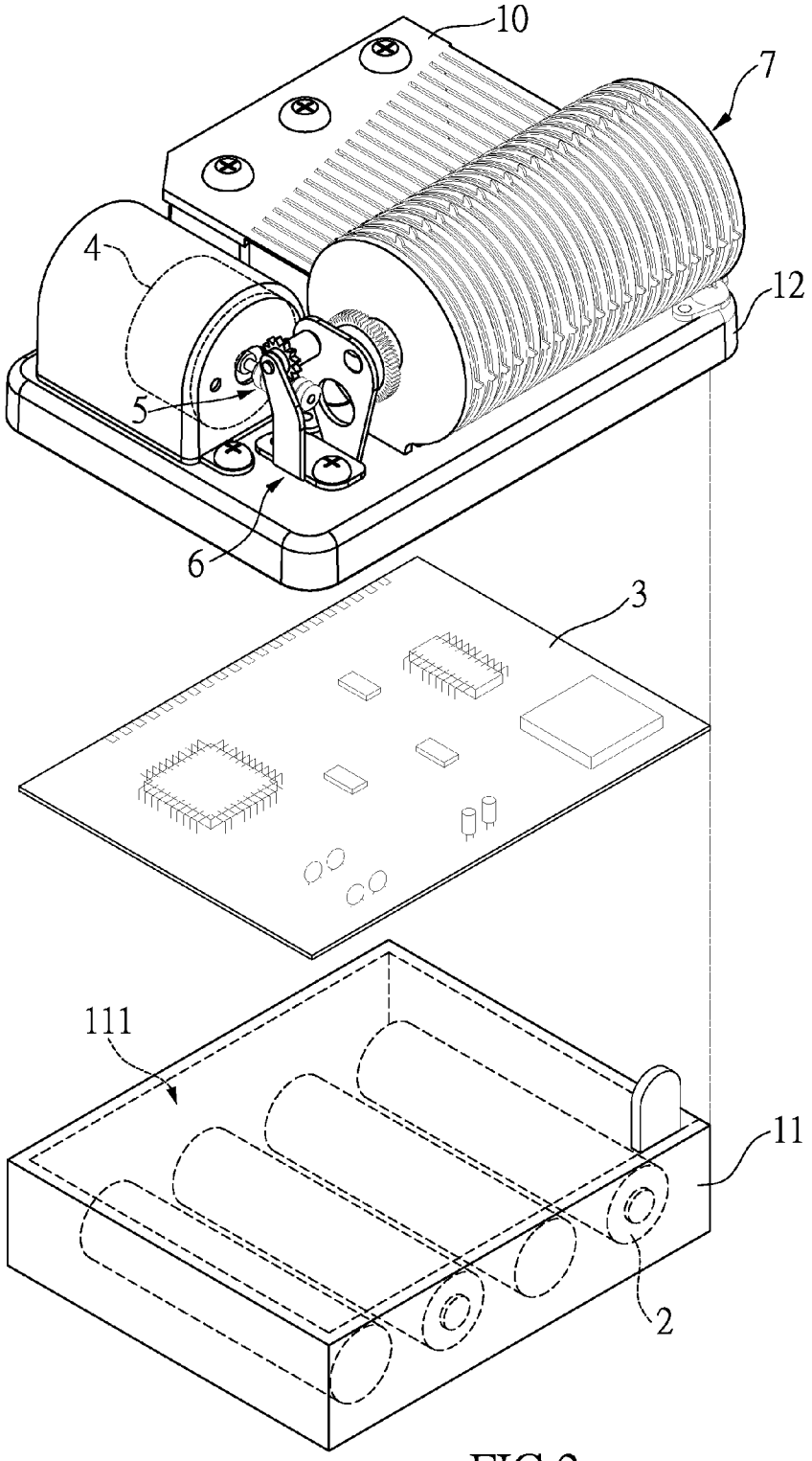
FIG. 2 is an exploded view of the music box of the present invention.
Figure 3:
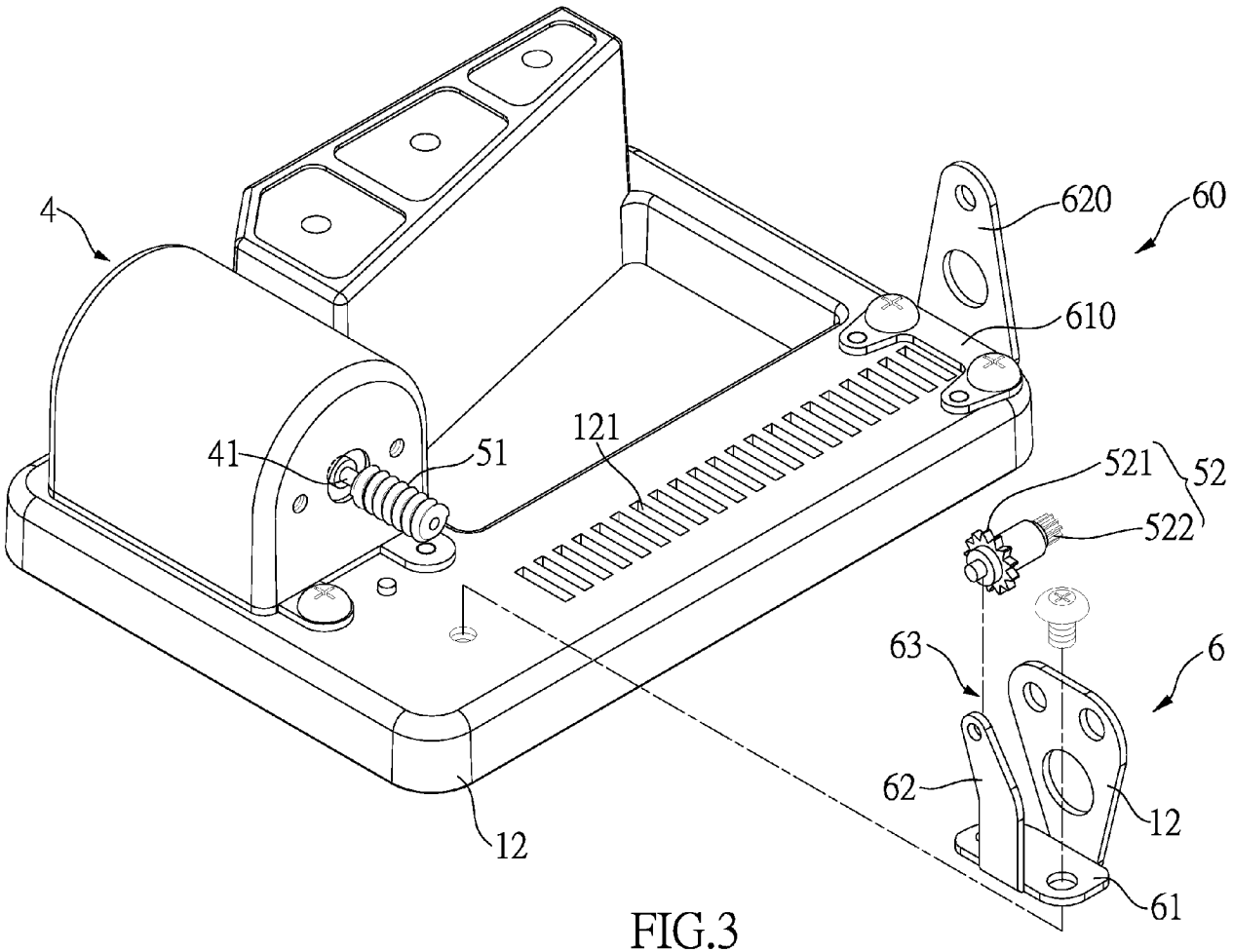
FIG. 3 is an exploded view of the operation unit of the music box of the present invention.
Figure 4:
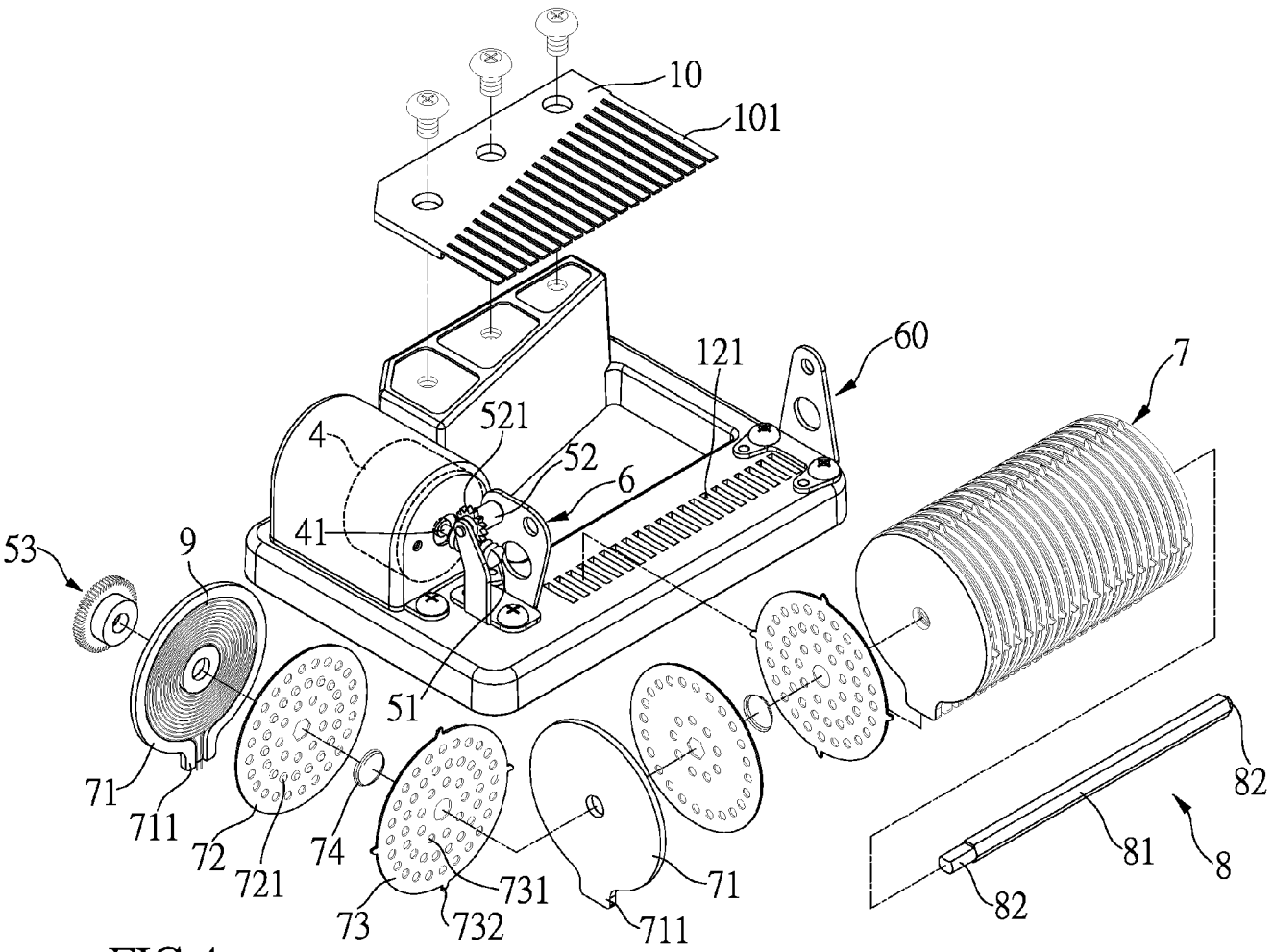
FIG. 4 is an exploded view of the activation units, the comb member and the shaft of the music box of the present invention.
Figure 5:
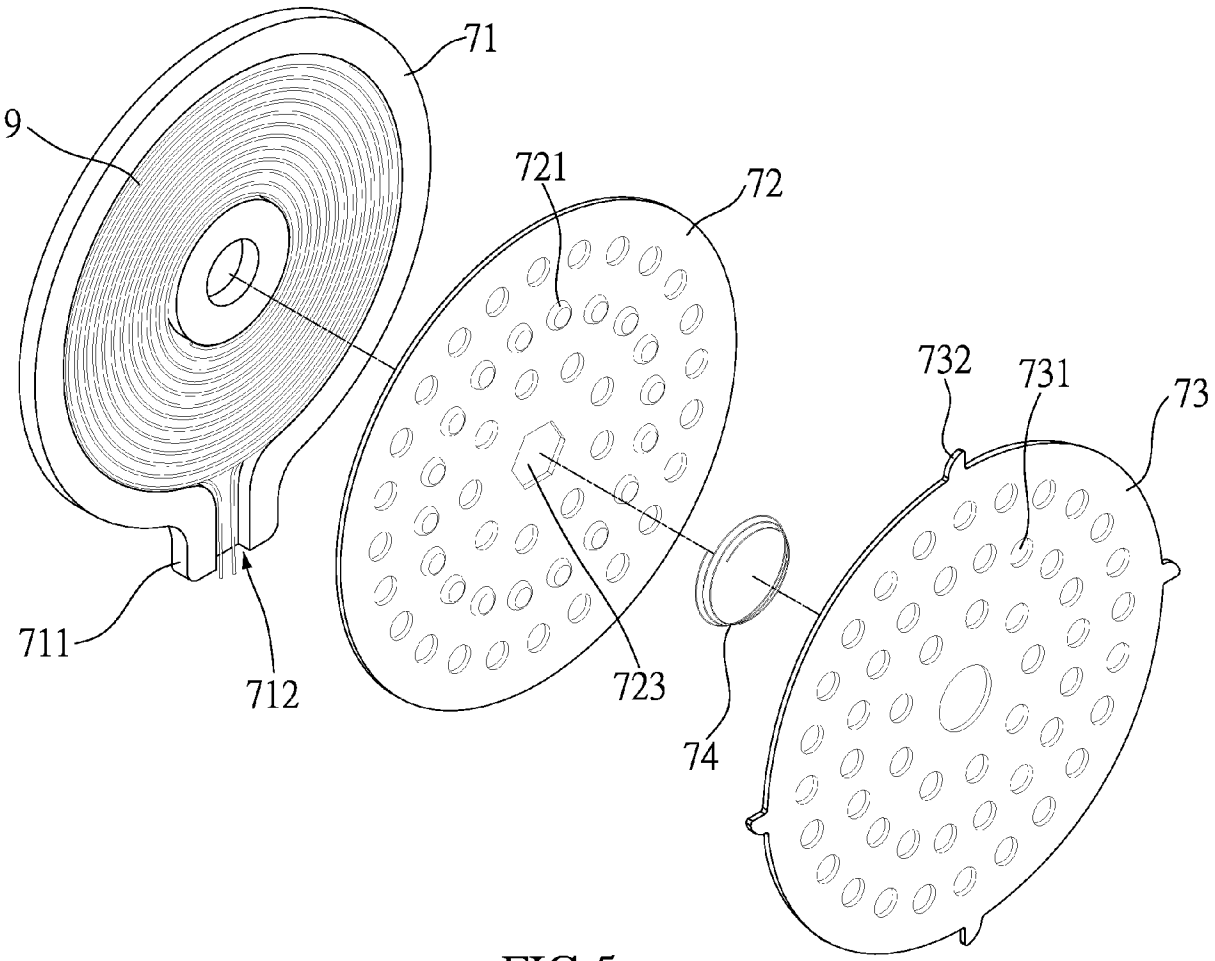
FIG. 5 is an exploded view of the magnetic plates, the match plates, the activation plates and the springs of the music box of the present invention.
Figure 6:
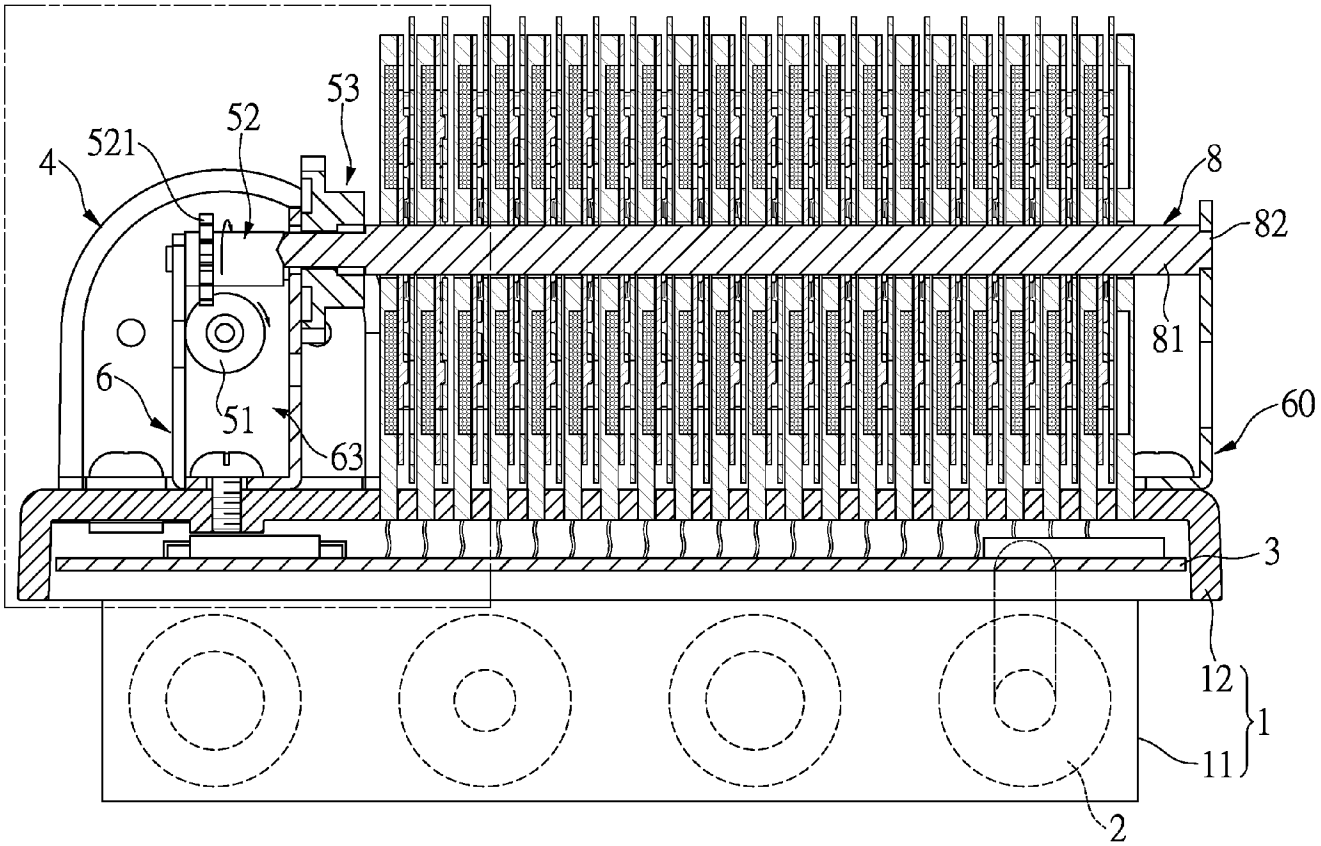
FIG. 6 is a cross sectional view, taken along line VI-VI of FIG. 1.
Figure 7:
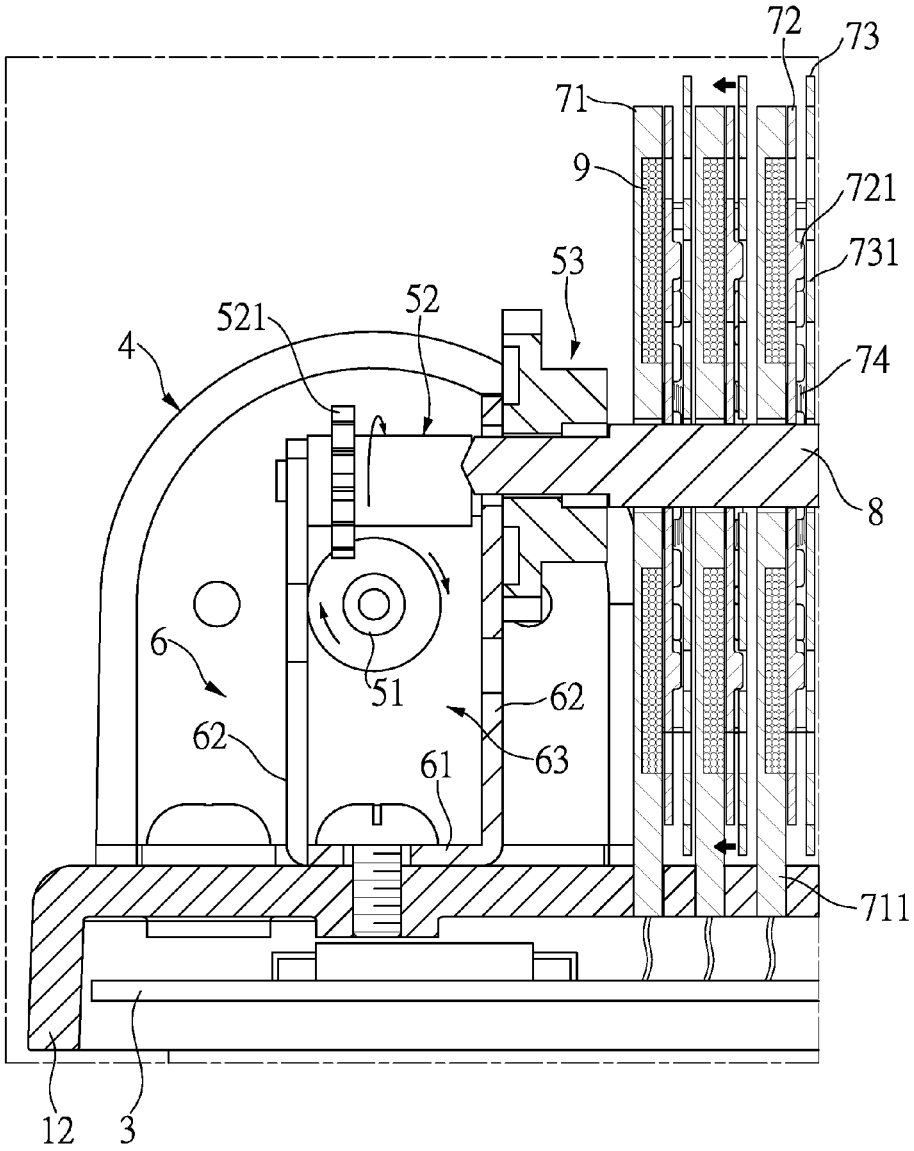
FIG. 7 shows that the driving member drives the operation unit of the music box of the present invention.
Figure 8:
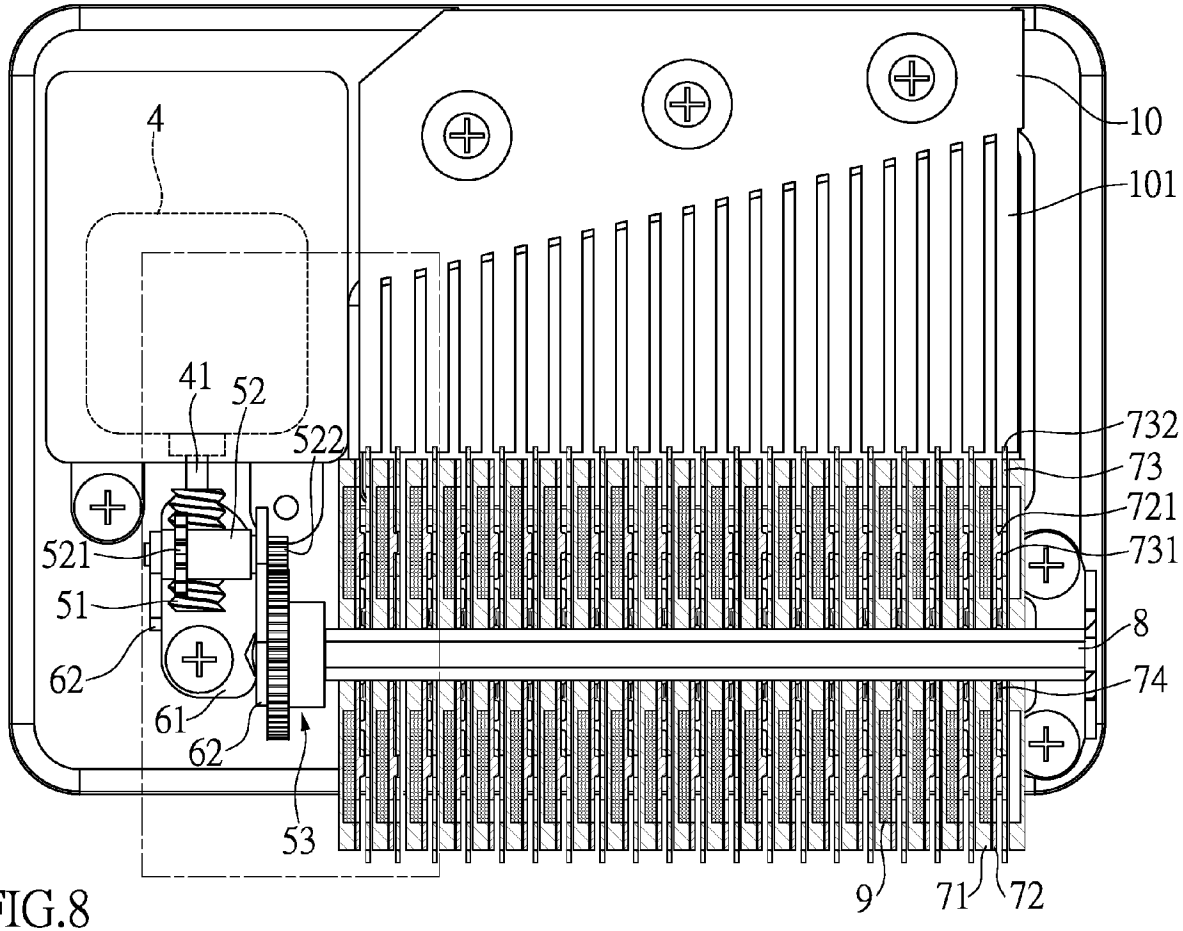
FIG. 8 is a cross sectional view, taken along line VIII-VIII of FIG. 1.
Figure 9:
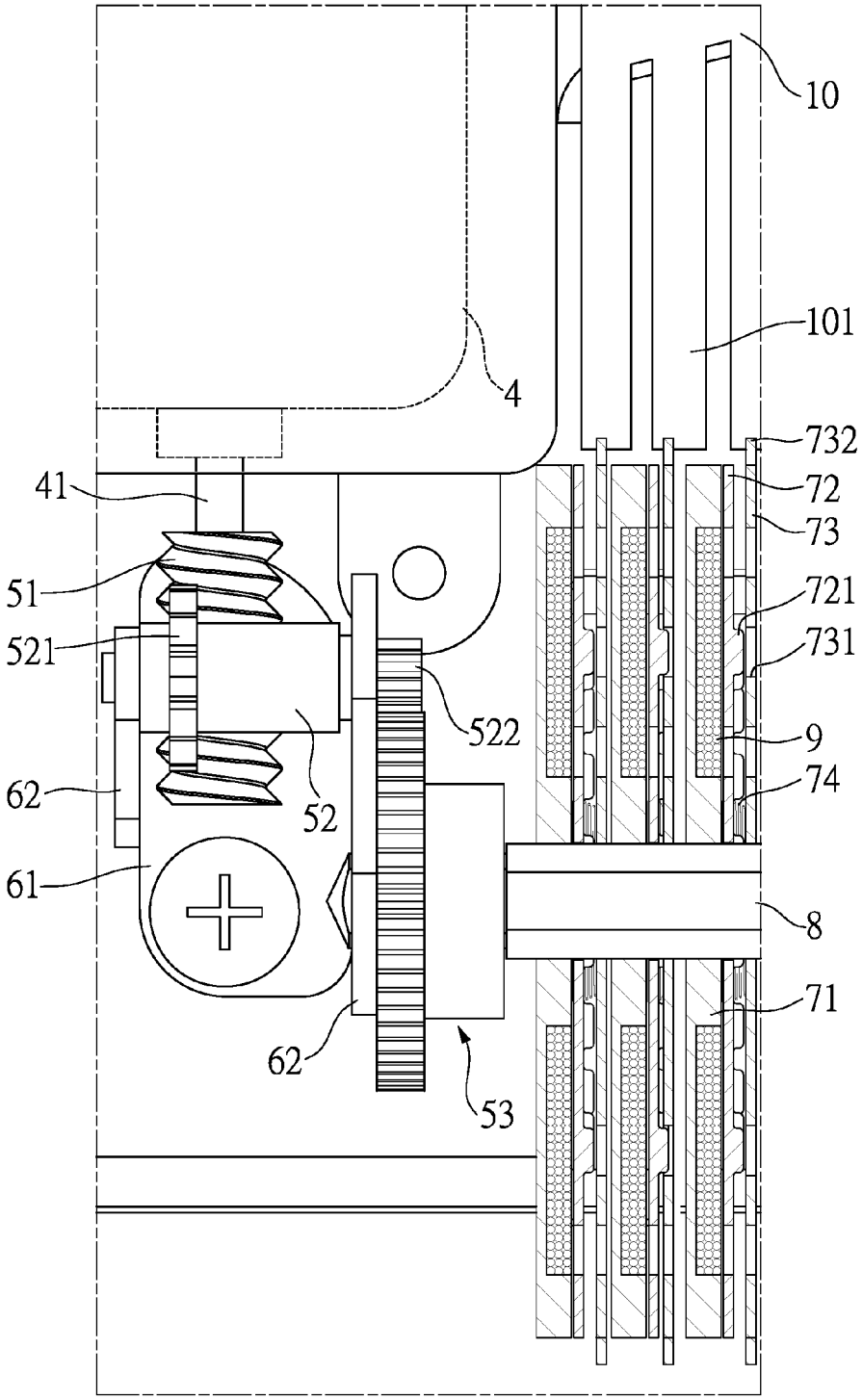
FIG. 9 shows that the match plate is magnetically attracted by the magnetic plate.
Figure 10:
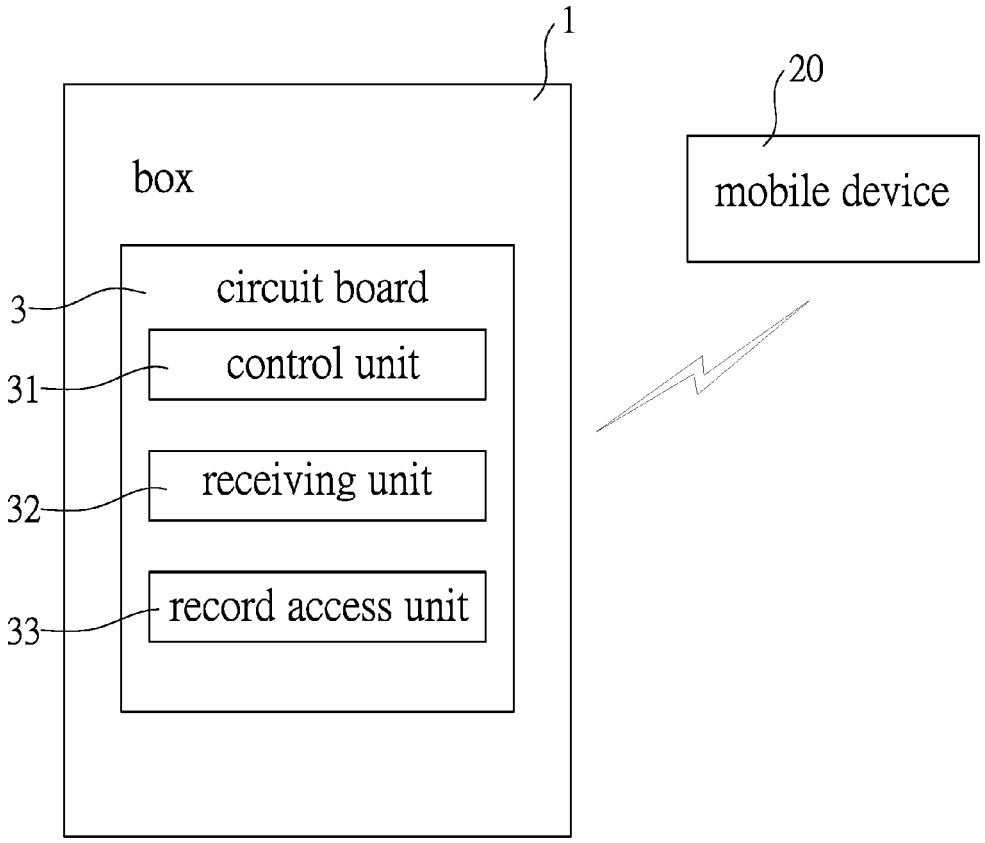
FIG. 10 shows the arrangement of the circuit board of the music box of the present invention.
Figure 11:
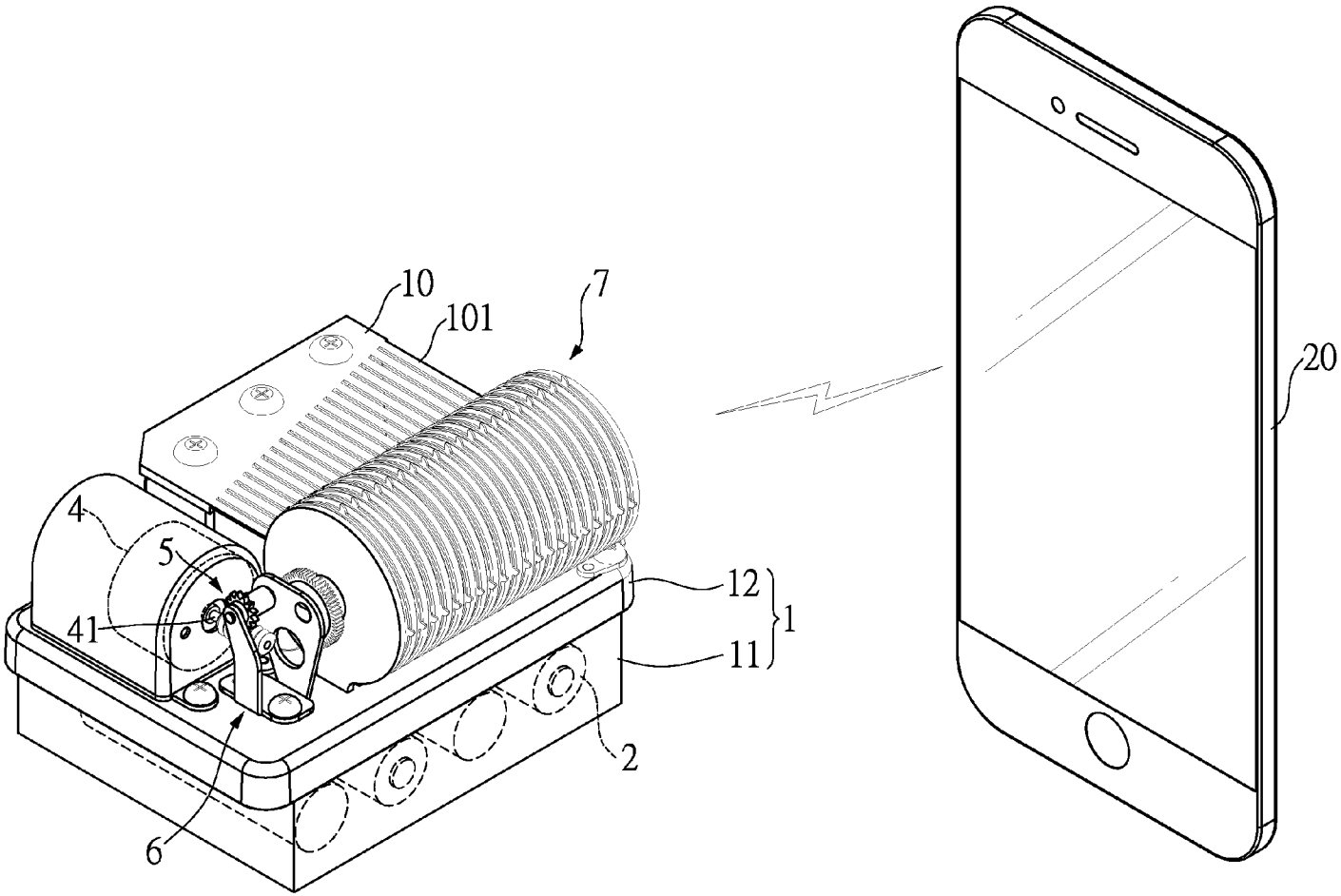
FIG. 11 shows the mobile device is connected to the circuit board by wireless way.

Referring to FIGS. 1 to 9, the music box of the present invention comprises a box 1 which includes a bottom part 11 and a top part 12. The bottom part 11 includes a room 111 defined therein. An electric power unit 2 and a circuit board 3 are received in the room 111. The top part 12 is mounted to the bottom part 11 to seal the room 111. The electric power unit 2 uses general batteries or rechargeable batteries. The inside of the room 111 are equipped with conduct plates which are designed to be in contact with the batteries. The electric power can also be provided by different devices such as USB, wired charging unit, or wireless charging unit. A driving member 4 is located on the top surface of the box 1. An operation unit 5 is located on the top surface of the box 1 and connected to the driving member 4. A first support 6 and a second support 60 are respectively located on the top surface of the box 1. The operation unit 5 is connected to the first support 6 that is located adjacent to the driving member 4.

Multiple activation units 7 are located between the first and second supports 6, and are connected to the operation unit 5. The first support 6 that is located adjacent to the driving member 4 includes two first side plates 62 and a first bottom plate 61 which is connected between the two first side plates 62. The first bottom plate 61 is fixed to the top part 12 by screws. A space 63 is formed between the two first side plates 62 of the first support 6. The operation unit 5 can be protected within the space 63. The second support 6 includes a second bottom plate 610 fixed to the top part by screws, and a second side plate 62 which is connected the first bottom plate 610 to form an L-shaped arrangement.

The operation unit 5 includes a first threaded rod 51, a second threaded rod 52 and a wheel gear 53. The first threaded rod 51 is connected to an output axle 41 of the driving member 4 and located in the space 63. The second threaded rod 52 is connected between the one of the two first side plates 62 and the second side plate 620. The second threaded rod 52 includes a disk gear 521 formed thereto which is engaged with the first threaded rod 51. The second threaded rod 52 further includes an operation gear 522 on one end thereof which protrudes beyond one of the two first side plates 62. The operation gear 522 is located corresponding to the activation units 7. The operational directions of the first and second threaded rods 51, 52 are different. The threads of the first threaded rod 51 is axially formed on the first threaded rod 51, and the threads of the second threaded rod 52 is perpendicular to the threads of the first threaded rod 51. As shown in FIGS. 3 and 6-9, when the first threaded rod 51 rotates clockwise, the disk gear 521 of the second threaded rod 52 rotates toward the driving member 4.

Each activation unit 7 has a magnetic plate 71, a match plate 72, an activation plate 73 and a spring 74. A shaft 8 extends through the multiple activation units 7, and the two ends of the shaft 8 are connected to the first and second supports 6. The shaft 8 includes a polygonal section 81 and two pivotal sections 82 between which the polygonal section 81 is located. The wheel gear 53 is mounted to the shaft 8 and engaged with the operation gear 522 of the second threaded rod 52. Each match plate 72 has an aperture 723 which is shaped to be matched with the polygonal section 81 so that the match plate 72 cannot rotated relative to the shaft 8. The spring 74 is located between the between the match plate 72 and the activation plate 73 of each activation unit 7. Therefore, when the music box is not in use, the spring separates the match plate 72 and the activation plate 73. The sequence of the magnetic plate 71, the match plate 72, the activation plate 73 and the spring 74 on the shaft 8 of each activation unit 7 is that the magnetic plate 71 is located close to the driving member 4 and the activation plate 73 is located remote from the driving member 4. A coil 9 is electrically connected with the circuit board 3 and located between the magnetic plate 71 and the match plate 72 of each activation unit 7. The magnetic plate 71 of each activation unit 7 includes a groove 712 defined in one side thereof which faces the match plate 72 corresponding thereto. The coil 9 is located in the groove 712 and only two wires extend beyond the groove 712 to he connected with the circuit board 3. By this way, the coil 9 is not interfered to affect the match plate 72 and the activation plate 73, and not to affect the movement of the activation plate 73. The match plate 72 of each activation unit 7 has multiple protrusions 721 extending from one side thereof that faces the activation plate 73 which has multiple holes 731 which are located corresponding to the protrusions 721. The spring 74 of each activation unit 7 is biased between the match plate 72 the activation plate 73. The circuit board 3 controls the coil 9 to generate electric power to magnetically attract the activation plate 73 to match the match plate 72 so as to engage the protrusions 721 with the holes 731. The driving member 4 drives the operation unit 5 to spin the shaft 8 which rotates the match plate 72 and the activation plate 73 that is matched with the match plate 72. The top part 12 includes multiple slots 121, and each magnetic plate 71 includes a connection portion 711 which is positioned in the slot 121 corresponding thereto.

A comb member 10 is located on the top surface of the box 1 and has multiple keys 101 extending therefrom. The keys 101 are located corresponding to the activation plates 73 of the activation units 7. Each activation plate 73 has multiple fingers 732 extending from the outer periphery thereof. The fingers 732 are designed to push the keys 101 to generate sound. The comb member 10 includes 18, 20, 30, 40 or 70 keys 101. The comb member 10 is located on the top surface of the box 1 such that the users can easily replace the comb member 10.

The circuit board 3 controls the coil 9 to generate electric power to magnetically attract the activation plate 73 to match the match plate 72 so as to engage the protrusions 721 with the holes 731. The operation of the operation unit 5 drives the shaft 8 to spin which rotates the match plate 72, and the activation plate 73 is then co-rotated with the match plate 72. The fingers 732 of the activation plate 73 pushes the keys 101 of the comb member 10 to generate music. The magnetic plates 71 and the activation plates 73 are made by magnetic metal so that they are matched to each other due to the magnetic field. The users may replace the comb member 10 to allow the music box to play desired music.

The circuit board 3 includes a control unit 31, a receiving unit 32 and a record access unit 33. The control unit 31 controls at least one coil 9 to generate electric power so as to form magnetic field with the magnetic plates 71, The receiving unit 32 receives music from a mobile device 20 by wireless way. The record access unit 33 stores and transfer the music into multiple music codes. The circuit board 3 and the mobile device 20 are connected to each other by way of Bluetooth, cloud or infer-red. The users use the mobile device 20 to transmit the music codes to the circuit board 3 which controls the movement of the activation units 7 to play desired music of different ranges, scales and tones.

The music box of the present invention is a compact music box wherein the magnetic plates 71, the match plates 72 and the activation plates 73 are thin plates which occupy less space. The number of the activation units 7 can be adjusted by the needs of the users. The comb member 10 can be made according to different needs so as to play different types of music. The connection between the mobile device 20 and the circuit board 3 allows the users to play even more music.

While we have shown and described the embodiment in accordance with the present invention, it should he clear to those skilled in the art that further embodiments may be made without departing from the scope of the present invention.

What is claimed is:

1. A music box comprising:

a box having an electric power unit and a circuit board received therein, a driving member located on a top surface of the box;

an operation unit located on the top surface of the box and connected to the driving member, a first support and a second support respectively located on the top surface of the box, the operation unit connected to the first support that is located adjacent to the driving member;

multiple activation units located between the first and second supports and connected to the operation unit, each activation unit having a magnetic plate, a match plate, an activation plate and a spring, a shaft extending through the multiple activation units, two ends of the shaft connected to the first and second supports, the spring located between the between the match plate and the activation plate of each activation unit, a sequence of the magnetic plate, the match plate, the activation plate and the spring on the shaft of each activation unit being that the magnetic plate is located close to the driving member and the activation plate is located remote from the driving member, a coil electrically connected with the circuit board being located between the magnetic plate and the match plate of each activation unit, the match plate of each activation unit having multiple protrusions extending from a side thereof that faces the activation plate which has multiple holes which are located corresponding to the protrusions, the circuit board controlling the coil to generate electric power to magnetically attract the activation plate to match the match plate so as to engage the protrusions with the holes, the driving member drives the operation unit to spin the shaft which rotates the match plate and the activation plate that is matched with the match plate, and a comb member located on the top surface of the box and having multiple keys extending therefrom, the keys located corresponding to the activation plates of the activation units, each activation plate having multiple lingers extending from an outer periphery thereof, the fingers pushing the keys to generate sound.

2. The music box as claimed in claim 1, wherein the box includes a bottom part and a top part, the bottom part includes a room defined therein, the electric power unit and the circuit board are received in the room, the top part is mounted to the bottom part to seal the room, the top part includes multiple slots, each magnetic plate includes a connection portion which is positioned in the slot corresponding thereto.

3. The music box as claimed in claim 2. wherein the first support that is located adjacent to the driving member includes two first side plates and a first bottom plate which is connected between the two first side plates, the first bottom plate is fixed to the top part by screws, a space is formed between the two first side plates of the first support, the second support includes a second bottom plate fixed to the top part by screws, and a second side plate which is connected the first bottom plate to form an L-shaped arrangement.

4. The music box as claimed in claim 3, wherein the operation unit includes a first threaded rod, a second threaded rod and a wheel gear, the first threaded rod connected to an output axle of the driving member and located in the space, the second threaded rod is connected between the one of the two first side plates and the second side plate, the second threaded rod includes a disk gear formed thereto which is engaged with the first threaded rod, the second threaded rod includes an operation gear on one end thereof which protrudes beyond one of the two first side plates, the operation gear is located corresponding to the activation units, the wheel gear is mounted to the shaft and engaged with the operation gear.

5. The music box as claimed in claim 1, wherein the shaft includes a polygonal section and two pivotal sections between which the polygonal section is located, each match plate has an aperture which is shaped to be matched with the polygonal section.

6. The music box as claimed in claim 5, wherein the comb member includes 18, 20, 30, 40 or 70 keys.

7. The music box as claimed in claim 1, wherein the magnetic plate of each activation unit includes a groove defined in one side thereof which faces the match plate corresponding thereto, the coil is located in the groove.

8. The music box as claimed in claim 1, wherein the circuit board includes a control unit, a receiving unit and a record access unit, the control unit controls at least one coil to generate electric power so as to form magnetic field with the magnetic plates, the receiving unit receives music from a mobile device by wireless way, the record access unit stores and transfer the music into multiple music codes.

9. The music box as claimed in claim 8, wherein the circuit board and the mobile device are connected to each other by way of Bluetooth, cloud or infer-red.

* * * * *